United States Patent [19]

Montaigne

[11] Patent Number: 4,830,141

[45] Date of Patent: May 16, 1989

[54] DEPLOYABLE RAIL STRUCTURE FOR HIGH-RISE BUILDING EVACUATION SYSTEM

[75] Inventor: Michael D. Montaigne, Tilton, N.H.

[73] Assignee: Pegasus International, Inc.,

[21] Appl. No.: 239,589

[22] Filed: Sep. 1, 1988

[51] Int. Cl.[4] ..... E04G 3/14; A62B 1/02; B66B 9/00

[52] U.S. Cl. ..... 182/82; 182/141; 182/178; 187/6

[58] Field of Search ..... 182/82, 100, 141, 133, 182/36, 41, 40, 178; 187/6

[56] References Cited

U.S. PATENT DOCUMENTS

| | | | |
|---|---|---|---|
| 3,016,989 | 1/1962 | Lindmark | 182/82 |
| 4,350,224 | 9/1982 | Jochum | 182/82 |
| 4,406,349 | 9/1983 | Vilchek | 182/82 |
| 4,425,982 | 1/1984 | Kibbie | 182/82 |
| 4,433,752 | 2/1984 | Gunter | 182/82 |
| 4,467,889 | 8/1984 | Maubach | 182/82 |
| 4,469,198 | 9/1984 | Crump | 182/82 |
| 4,569,418 | 2/1986 | Novarini | 182/82 |

*Primary Examiner*—Reinaldo P. Machido
*Attorney, Agent, or Firm*—Kenyon & Kenyon

[57] ABSTRACT

Individual rail segments of a deployable exterior elevator rail structure are stored horizontally on each floor of a high-rise building. When actuated from a ground level control panel, closure panels swing aside to provide access openings through which linear actuators translate and rotate the rail segments to a vertical deployed position. Motor driven threaded bolts automatically secure the ends of adjacent rail segments together, and the linear actuators rigidly brace the deployed rail structure in front of the face of the building.

13 Claims, 4 Drawing Sheets

DEPLOYABLE RAIL STRUCTURE FOR HIGH-RISE BUILDING EVACUATION SYSTEM

BACKGROUND OF THE INVENTION

1. Technical Field

This invention relates to emergency fire fighting and rescue systems for high-rise buildings, and particularly to systems that incorporate an outside elevator using an exterior track on an outside wall of the building.

2. Background Art

The development of hydraulically operated high lift ladders for fire engines has reduced the importance of external fire escapes for relatively low multistory buildings, but the maximum reach of such ladders is only about twelve stories. As the result of several major fires in high-rise hotel and office buildings, there has been increased attention directed to the problem of evacuating people from the upper floors of very tall buildings in an emergency when interior elevators and stairways cannot be used.

Examples of external elevator systems for emergency evacuation and fire fighting are disclosed in U.S. Pat. Nos. 4,018,306 of LYONS; 4,569,418 of NOVARINI; and 4,664,226 of CENTANNE. These systems use cable hoists or rack and pinion drives to raise and lower cars or gondolas on a vertical rail or rails that are mounted on the exterior face of a building.

One of the objections to installing such a system on many buildings is that the permanent presence of vertical rails on the face of the building would mar the appearance and architectural integrity of the design. In addition, on many buildings there is no external structure to which to secure the rails. This is particularly true of glass sheathed and other curtain wall buildings in which the entire exterior surface consists of relatively lightweight panels secured by clips to the building frame.

Penetrations through these this building skins for permanent rail supports not only would be unsightly but also would be sites for potential leaks.

SUMMARY OF THE INVENTION

The present invention solves the above problem by providing rail units that store individual rail sections on each floor inside a building and automatically deploy these rail sections to form a connected vertical rail structure extending along an exterior face of the building upon command in the event of a fire or other emergency.

In particular, the present invention provides, in an external fire fighting and rescue system for high rise buildings including a vertical rail structure accessible from the exterior of the building for guiding a gondola to move up and down the face of the building, the improvement wherein the rail structure comprises a plurality of deployable rail units, at least one rail unit being located on each of a succession of floor levels, each rail unit comprising:

an elongated rail segment having a length approximately equal to the floor-to-floor spacing in the building;

a pivot member fixed with respect to the rail segment at a location intermediate between a first end and a second end of the rail segment;

means for supporting the rail segment in a first stored position inside the building;

means for translating the rail segment and for rotating the rail segment in a vertical plane on the pivot member between the first stored position and a second deployed position in which the rail segment is disposed outside the building approximately vertically with the first end down and in mating contact with the second end of another deployed rail segment directly below; and means for securing the first end of the first mentioned rail segment to the second end of the other rail segment directly below when the rail segments are in the second deployed position.

The means for translating and pivoting the rail section may comprise a linear extension and retraction device having a first end connected to the building and a second end connected to the rail section at a point intermediate between the stop member and the second end of the rail section. This linear device may have the added function of stabilizing the rail section in the vertical deployed position.

The support means may comprise a guide support located inside the building adjacent to an exterior wall, and the translating means may additionally, or alternatively, comprise a gear rotatably mounted on the guide support, a rack extending longitudinally along the rail section between the first end of the rail section and the stop member, the gear meshing with the rack, and means for rotating the gear to cause the rail section to translate over the guide support and to extend outwardly from the face of the building.

Preferably, the first end of each rail section overlaps the second end of a rail section directly below when the rail sections are in the second deployed position, and the means for securing the first end on one rail section with the second end of another rail section may comprise an externally threaded member located at one of the first end of the upper rail section and the second end of the lower rail section, a mating internally threaded member located at the other of the first end of the upper rail section and the second end of the lower rail section, and means for rotating one of the threaded members with respect to the other to fasten the first and second ends of the upper and lower rail sections together when the rail sections are in the second deployed position.

The foregoing and other features and advantages of the invention will be made clearer from the following description of the preferred embodiments as illustrated in the accompanying drawings.

DETAILED DESCRIPTION OF THE PREFERRED EMBODIMENTS

Figure 1:
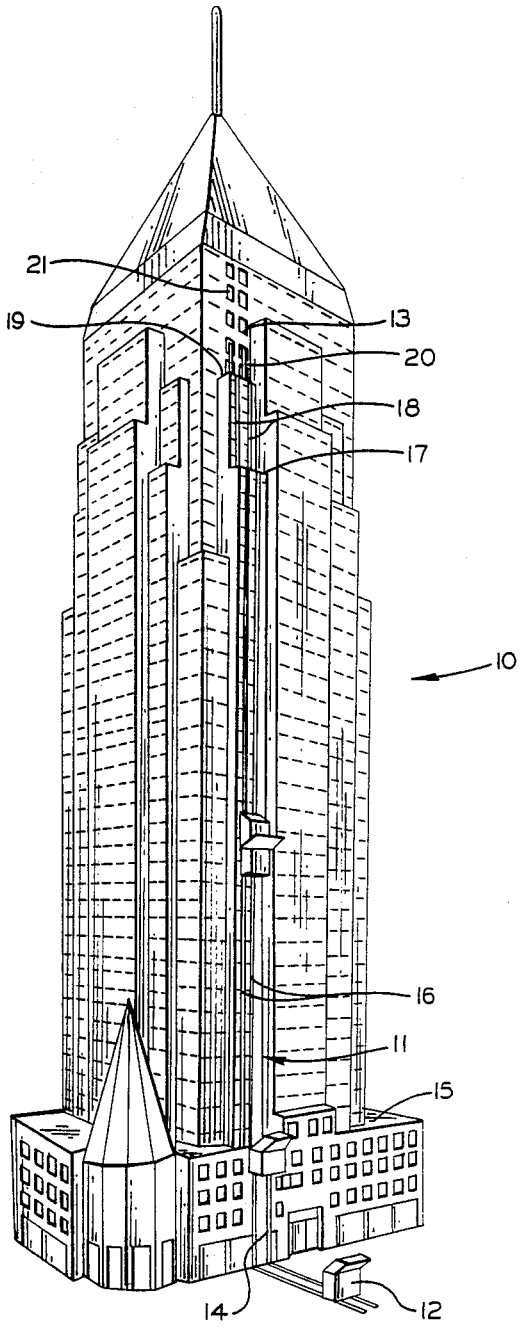
FIG. 1 is a perspective view of deployable rail units of an emergency fire fighting and rescue system installed on a high-rise building.
Figure 2:
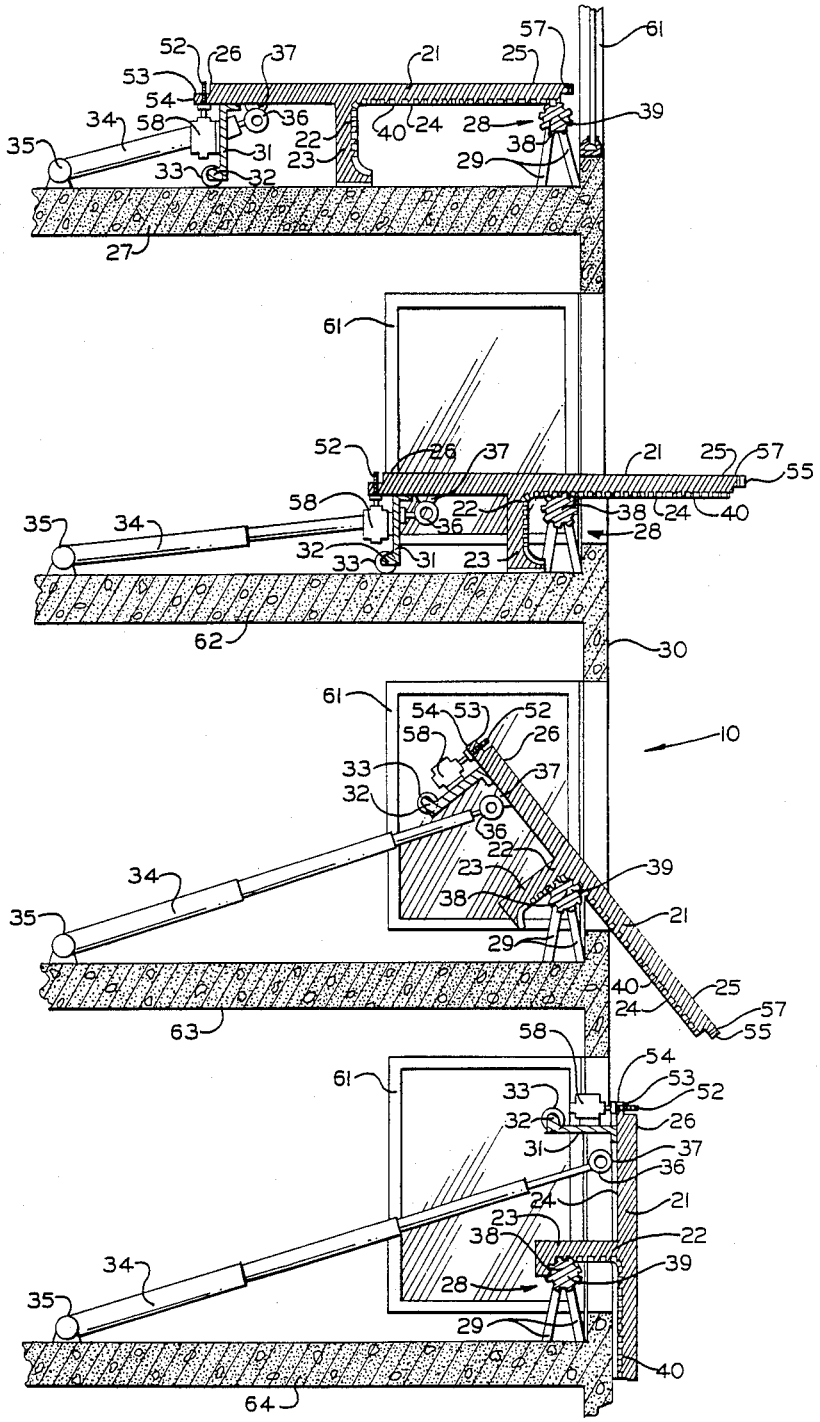
FIG. 2 is a side elevation view in cross section, of part of the rail units shown in FIG. 1 in various stages of deployment.

With reference to FIGS. 1 and 2, a multi-story high-rise building 10 is equipped with a vertical rail system 11 for guiding and supporting gondolas 12 of an emergency fire fighting and rescue system such as is disclosed in copending patent application Ser. No. 07/222,622 of Michael D. Montaigne and Bernard Lietaer filed on July 21, 1988. In the present invention, instead of being permanently fixed to the exterior face of a building the vertical rail system 11 includes individual rail units 13 that are deployable from horizontal stowed positions inside the building to vertical deployed positions along the exterior face of the building in the event of a fire or other emergency. The rail units thus are preserved in a protected environment free from corrosion, and they do not detract from the architectural integrity of the building design.

FIG. 1 illustrates the application of a deployable vertical rail system to a building with multiple setbacks and shows several rescue gondolas in the process of scaling the building face on already deployed rail units, while rail units in the uppermost stories are being deployed from their stowed positions inside the building. The gondolas 12 are of the type disclosed in the copending application of Montaigne et al. and are specially adapted for use where setbacks require discontinuous offset sections of vertical rails. In the illustrated arrangement, a first section 14 of parallel rail units extends from ground level to a first setback 15, a second section 16 leads from the first setback 15 to a second setback 17, a third section 18 continues to a third setback 19, and a fourth section 20 rises to the top story of the building. The top three rail units in the fourth section are in various stages of deployment, as shown more clearly in FIG. 2, and in the alternative embodiment of FIG. 5, and their construction and operation will be described in connection with those figures.

In general, deployment will be initiated by fire and rescue personnel who arrive at the scene in response to an alarm. Typically, the gondolas for use with the fire and rescue system will be kept on special vehicles (not shown) equipped with electric generators and appropriate rescue gear and fire fighting equipment at a central station. A separate gondola is needed for each section of rail units. As shown in FIG. 1, two piggybacked gondolas are climbing the second rail section 16, a third gondola is at the top of the first section 14, and a fourth gondola is moving into position at the bottom of the first section.

When the lower of the first two gondolas reaches the top of the second rail section, the upper gondola will roll off the top of the lower gondola, cross the second setback, and engage the rails of the third section 18. Meanwhile, the fourth gondola will engage the first rail section and climb to the top, lifting up the third gondola to a level where it can roll onto and across the first setback to engage the second rail section, just as did the first and second gondolas preceding it. The third gondola then rises to the top of the second rail section, lifting the second gondola up off the rails until it can roll across the second setback and climb the third rail section to boost the first gondola up to the third setback level. The first gondola can then roll across the third setback and engage the fourth and last rail section which by then has fully deployed. To return to ground level with persons rescued from the uppermost floors, the above procedure is repeated in reverse.

The means for raising the gondolas is not part of the present invention and will not be described in detail. Preferably the gondolas are self-propelled by electric motors that receive power either through cables connected to mobile generators (not shown) or from electric bus bars (not shown) forming an integral part of the rail units. The deployable rail system of the present invention can be used with gondolas hoisted by a winch and cable system (not shown) or with any other suitable lifting means. In addition, the deployable rail system can be installed to provide a parallel dual track, as shown, or just a vertical monorail.

Figure 3:
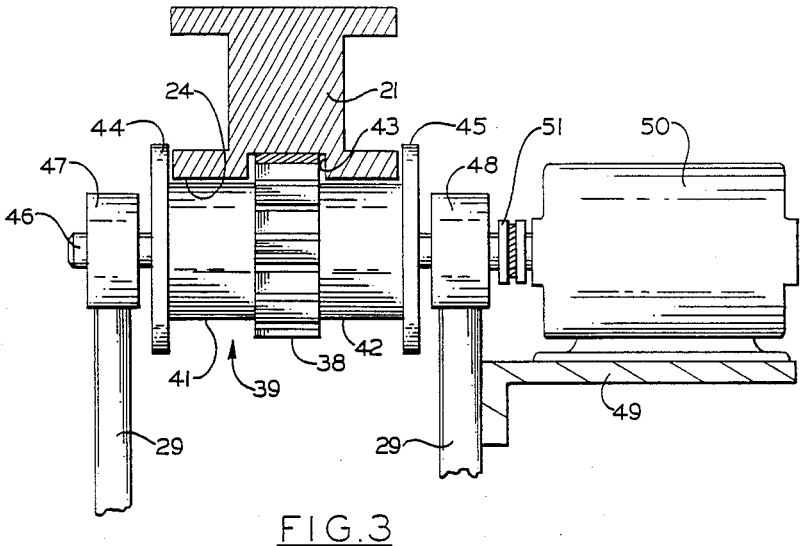
FIG. 3 is a front elevation view in partial cross section, taken along the line between arrows III—III of FIG. 2 but at an enlarged scale, of a gear drive for translating and rotating a rail unit to the deployed position.
Figure 4:
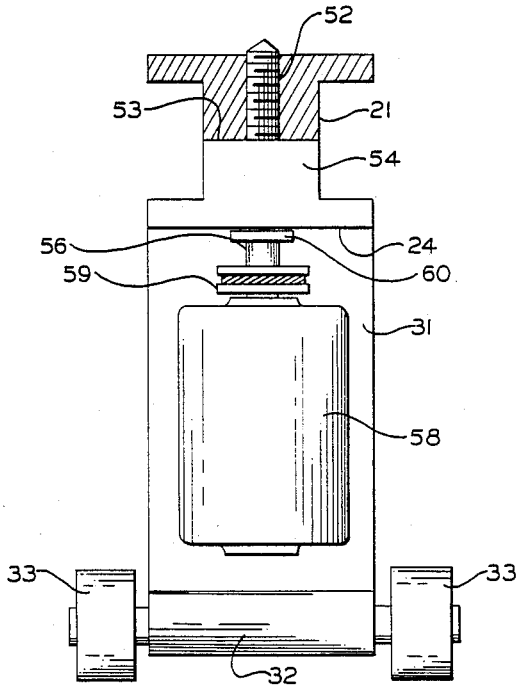
FIG. 4 is an end view, taken along the line between arrows IV—IV of FIG. 2 but at an enlarged scale, of means in the embodiment of FIG. 2 for securing the lower end of one rail unit to the upper end of a next lower rail unit when in the deployed position.

As shown in FIGS. 2–4, one preferred embodiment of a rail unit according to the invention comprises a rail segment 21 provided with a pivot member 22 in the form of a stop member 23 that extends laterally from one side 24 of the rail segment intermediate between a first end 25 and a second end 26 of the rail segment. The side 24 of the rail segment constitutes the rear face, i.e., the face nearest the building, when the rail segment is in its deployed position. The length of each rail segment is equal approximately to the floor-to-floor spacing of the building.

The rail segment for each story of the building normally is kept in a horizontal first stored position inside the building, as shown on the top floor 27 in FIG. 2. In this stored position, the first end 25 of the rail segment rests on a support means such as guide support 28 mounted on legs 29 inside the building adjacent to an exterior face 30 of the building. At the second end 26 of the rail segment, a bracket 31 has an outer end 32 provided with wheels 33 (only one wheel shown in FIG. 2) that rest on the floor 27. The length of the bracket 31 is selected so that the rail segment will be supported substantially horizontally.

A linear extension and retraction means or actuator in the form of a multiple section hydraulic cylinder and piston unit 34 has a first end 35 connected to the floor of the building and a second end 36 connected to the rail segment at a point 37 intermediate between the stop member 23 and the second end 26 of the rail segment. In addition, the guide support 28 carries a gear 38 formed on a roller 39, the gear meshing with a rack 40 mounted on the rear face of the rail segment between the first end and the stop member and curving around to extend along the adjoining face of the stop member. The arrangement of the gear and roller is shown in FIG. 3, which is an enlarged partial cross section taken along the line connecting arrows III—III in FIG. 1. In FIG. 3, the roller 39 has too contact surfaces 41, 42 flanking the centrally located gear 38. The rear face 24 of the rail segment 21 rests on the contact surfaces of the roller, and the rack 40 is mounted in a central longitudinal slot 43 in the rear face 24 to engage the teeth of the gear 38. Flanges 44, 45 at each end of the roller guide the rail segment and keep it aligned on the roller. A coaxial shaft 46 supports the roller in two bearings 47, 48 mounted on top of the legs 29. A bracket 49 that is welded or otherwise secured to one of the sets of legs 29 supports an electric motor 50, the motor being coupled to the roller shaft by a flexible coupling 51.

Although the rail segment is shown as having a modified I-beam shape, this is by way of example only. Many other shapes are possible, depending on the design of the gondolas with which the rail system is to be used. Also, the gear 38 does not have to be formed integrally with or centrally located on the roller, nor does it have to be coaxial with the roller.

The rack and gear, the stop member, and the linear extension and retraction means together constitute means for translating the rail segment over the guide support and for rotating the rail segment in a vertical plane about the guide support between a first stored position, in which the rail segment is disposed inside the building and extends approximately perpendicularly to the face of the building, as shown on the top floor of the four floor group of rail units pictured in FIG. 2, and a second deployed position, in which the rail segment is disposed outside the building approximately vertically with the first end down, as shown on the lowest floor pictured in FIG. 2.

The rail unit embodiment of FIG. 2 also includes means for securing the first end on one rail segment with the second end of a rail segment directly below, when the rail segments are in the second deployed position. As shown most clearly in FIG. 4, the securing means of the FIG. 2 embodiment comprises an externally threaded member 52 located at the second end of the lower rail segment and projecting from a front face 53 of a stepped portion 54 at the second end of the segment. This stepped portion 54 is overlapped by a mating stepped portion 55 on the first end of the upper rail segment when the two segments are vertically aligned in the deployed position. The externally threaded member constitutes the forward end of a shaft 56 that is rotatably journaled in a bearing (not shown) in stepped portion 54 of the lower rail segment and engages an internally threaded hole 57 (see FIG. 2) in the stepped portion 55 of the upper rail segment when each pair of rail segments come into alignment. An electric motor 58 mounted on the bracket 31 is connected via a flexible coupling 59 to the shaft 56 of the threaded member, and the shaft has a shoulder 60 that bears against the rear face 24 of the second end of the lower rail segment. This shoulder allows the externally threaded member to draw the upper and lower rail segments together when it is rotated by the motor into the internally threaded hole 57.

The operation of the rail unit embodiment of FIGS. 2–4 is as follows. Upon the occurrence of an emergency requiring evacuation of floors too high to be reached by conventional ladder trucks, the rail units can be actuated by authorized personnel from a control panel (not shown) located at ground level. The control panel may be supplied with power from a separate permanent source or alternatively from a mobile generator brought to the scene in response to an alarm. When the system is actuated, a closure means 61, which may be a window or may be an opaque panel, shown as being shut on the top floor of FIG. 2 automatically swings aside by means of a mechanism (not shown) to provide an open access way, as pictured on the lower floors in FIG. 2. The gear drive motor 50 and the linear hydraulic actuator 34 then operate in synchronism first to translate the rail segment longitudinally to the position shown on the floor 62 below the top floor in FIG. 2, next to start to pivot the rail segment on the guide support as the gear rounds the intersection between the rail segment and the stop member 23, as shown on the next lower floor 63 in FIG. 2, and finally to complete rotating the rail segment to the vertical position as the gear moves to the outer end of the stop member, thereby displacing the rail segment outward to clear the outer face of the building, as shown on the bottom floor 64 of FIG. 2. When the gear 38 reaches the outer end of the stop member, a limit switch (not shown) turns off the drive motor 50.

As the first end 25 of each rail segment nears the second end 26 of the rail segment below it, a suitably placed microswitch (not shown) actuates the motor 58 to rotate the externally threaded member 52. When the member engages the internally threaded hole 57 in the upper rail segment, it screws in until the two rail segments are tightly secured together. A switch sensitive to an appropriate parameter, such as torque, motor current, pressure between the two rail segments, motor temperature, and so forth, then turns the motor off. The rail segments are thus securely joined together, end to end, and are rigidly braced in front of the building face by the extended linear actuator 34 and by the stop member held in place on the guide support by the gear 38.

Figure 5:
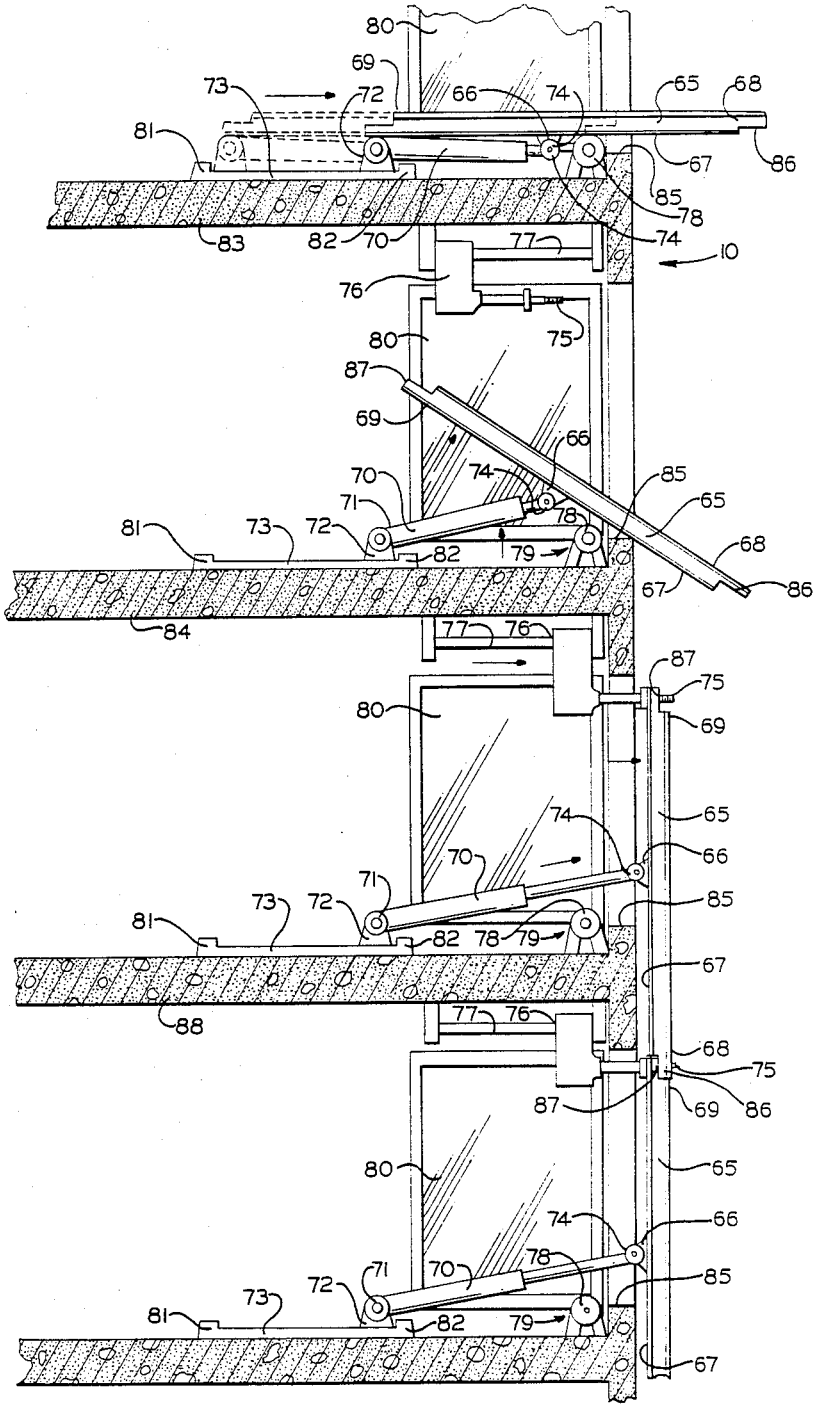
FIG 5 is a side elevation view, in cross section, of an alternative embodiment of the rail units shown in various stages of deployment.

FIG. 5 illustrates a group of rail units according to another embodiment of the invention. Each rail unit includes an elongated rail segment 65 having a pivot member 66 attached to one side 67 of the rail segment at a location intermediate between a first end 68 and a second end 69 of the rail segment. As in the first embodiment of FIG. 2, the length of the rail segment is equal to approximately the floor-to-floor spacing, and the one side of the rail segment constitutes the rear face of the rail segment when the rail segment is in the deployed position. This embodiment differs from the previous one, however, in that a linear actuator 70 has a first end 71 connected to the building via a rotary actuator 72 mounted on a slide mechanism 73 and a second end 74 connected directly to the pivot member 66. In this embodiment, moreover, it is important that the pivot member be located closer to the second end of the rail segment than the center of balance, so the rail segment tends to rotate around the pivot member to a vertical position with the first end down.

This embodiment also has a means for securing the first end of one rail segment with the second end of another rail segment directly below when the rail segments are in the fully deployed vertical position. The securing means in this case also incorporates an externally threaded member 75, but the member is carried by a rotary drive unit 76 that is mounted on a slide mechanism 77 attached to the building instead of being mounted on the rail segment.

The operation of the rail unit embodiment of FIG. 5 is as follows. Just as with the first embodiment, the initially stored position of the rail segment is horizontal, with its first end resting on a roller 78 of a guide support 79 and its second end resting on the rotary actuator 72. The first step at the time of system actuation is to swing the window 80 out of the way to provide an access opening to the exterior of the building. Next, a drive device (not shown) of the slide mechanism 77 moves the rotary actuator 72 from a rear end 81 of the slide to a front end 82. This moves the rail unit from the fully stored position, shown in dashed lines on the top floor 83 of the building in FIG. 5, to an extended position, as shown in solid lines. During this longitudinal translation the forward portion of the rail segment is carried on the roller of the guide support.

When the rotary actuator reaches the end 82 of the slide, the rotary actuator starts to rotate the linear actuator 70 counterclockwise, and at the same time the linear actuator starts to extend, as shown on the floor 84 next below the top floor in FIG. 5. The off-balance rail segment begins to turn around the first end of the linear actuator and to move further out of the window. At this point the rear surface of the rail segment no longer is supported by the roller 78 but slides over the sill 85 of the access opening. The rotary actuator stops when the fully extended second end 74 of the linear actuator 70 reaches a predetermined level such that a stepped first portion 86 of the first end of the rail segment will overlap a mating stepped second portion 87 of the rail segment below, as shown on the floor 88 next below in FIG. 5.

Meanwhile, the drive unit 76 for the externally threaded member 75 advances on the slide mechanism 77 from a retracted position, which permits the deploying rail segment to swing clear, to an extended position in which the externally threaded member is inserted through a clearance hole in the stepped portion 87 of the second end of the fully deployed rail segment next below. As the first end of the deploying rail unit nears the second end of the rail segment next below, the drive unit starts to rotate the threaded member, and the member screws into an internally threaded hole in the stepped portion 86 of the first end of the upper rail segment, to secure the two rail segments together in the same manner as for the embodiment of FIG. 2. When thus secured, the rail segments of the second embodiment are rigidly braced in front of the building face by the rotary drive unit 76 and by the extended linear actuator 70.

The use of a single linear actuator in combination with a rotary actuator simplifies the unit of FIG. 5. In addition, by mounting the linear actuator on the slide mechanism 73, it is possible to use a linear actuator having a shorter stroke than is required for the actuator in FIG. 2. Although only two embodiments of the deployable rail unit of the invention have been illustrated, it will be clear to those in the art that many changes and substitutions are possible. For example, the linear actuators can be pneumatic or hydraulic pistons and cylinders or they can be ball screw actuators. The slide mechanism and shorter stroke linear actuator of FIG. 2 can be substituted for the longer stroke linear actuator of FIG. 2, and the railmounted securing means of FIG. 2 can be substituted for the building-mounted securing means of FIG. 5. In addition, the rotary actuator of FIG. 5 could be replaced by some other device for raising and lowering the first end of the linear actuator.

It is also possible to provide auxiliary power circuits and backup manual operation of many of the devices in the event of damage to the primary power distribution system. For example, power can be supplied from extension cords carried by the gondolas to local input receptacles (not shown) provided near the access opening of each floor to bypass damaged lines at that floor or at a floor of a preselected group of floors above. The access closures can be designed for manual as well as automatic opening, and the several actuators and motor drives can have alternative hand cranks or similar manual operating devices. This will enable persons waiting to be evacuated to operate the rail deployment system themselves in case there is localized damage to the power actuating apparatus or loss of power for any reason.

It is clear, therefore, that the deployable rail system of the present invention provides an efficient and effective arrangement for equipping buildings with an external fire fighting and rescue elevator system without detracting from the aesthetic appearance of the building with permanently installed exterior rails. In addition, the rail units of the present invention are kept clean and corrosion free, in fully operable condition for use in time of an emergency.

I claim:

1. In an external fire fighting and rescue system for high-rise buildings including a vertical rail structure accessible from the exterior of the building for guiding a gondola to move up and down the face of the building, the improvement wherein the rail structure comprises a plurality of deployable rail units, at least one rail unit being located on each of a succession of floor levels, each rail unit comprising:

an elongated rail segment having a length approximately equal to the floor-to-floor spacing in the building;

a pivot member fixed with respect to the rail segment at a location intermediate between a first end and a second end of the rail segment;

means for supporting the rail segment in a first stored position inside the building;

means for translating the rail segment and for rotating the rail segment in a vertical plane on the pivot member between the first stored position and a second deployed position in which the rail segment is disposed outside the building approximately vertically with the first end down and in mating contact with the second end of another deployed rail segment directly below; and means for securing the first end of the first mentioned rail segment to the second end of the other rail segment directly below when the rail segments are in the second deployed position.

2. The rail unit of claim 1 wherein the support means comprises a guide support mounted inside the building adjacent to an exterior face of the building, and the pivot member comprises a stop member that extends laterally from the rail segment at the intermediate location between the first and second ends of the rail segment.

3. The rail unit of claim 2 wherein the guide support comprises a roller that contacts and supports a longitudinal surface of the rail segment when the rail segment is in the first stored position and that contacts and supports a lateral surface of the stop member when the rail segment is in the second deployed position.

4. The rail unit of claim 3 wherein the means for translating the rail segment comprises a gear rotatably mounted on the guide support, a rack extending longitudinally along the rail segment between the first end of the rail segment and the stop member, the gear meshing with the rack, and means for rotating the gear to cause the rail segment to translate over the guide support and to extend outwardly from the face of the building.

5. The rail unit of claim 4 wherein the gear is mounted coaxially with the roller.

6. The rail unit of claim 2 wherein the means for translating the rail segment comprises a gear rotatably mounted on the guide support, a rack extending longitudinally along the rail segment between the first end of the rail segment and the stop member, the gear meshing with the rack, and means for rotating the gear to cause the rail segment to translate over the guide support and to extend outwardly from the face of the building.

7. The rail unit of claim 6 wherein the means for translating the rail segment further comprises a linear extension and retraction device having a first end connected to the building and a second end connected to the rail segment at a point intermediate between the stop member and the second end of the rail segment.

8. The rail unit of claim 1 wherein the means for translating the rail segment comprises a linear extension and retraction device having a first end connected to the building and a second end connected to the rail segment at a point intermediate between the stop member and the second end of the rail segment.

9. The rail unit of claim 8 wherein the point of connection of the second end of the linear extension and retraction device is at the pivot member.

10. The rail unit of claim 1 wherein the first end of each rail segment overlaps the second end of a rail segment directly below when the rail segments are in the second deployed position, and the means for securing the first end of one rail segment to the second end of a rail segment directly below when the rail segments are in the second deployed position comprises an externally threaded member located at one of the first end of the upper rail segment and the second end of the lower rail segment, a mating internally threaded member located at the other of the first end of the upper rail segment and the second end of the lower rail segment, and means for rotating one of the threaded members with respect to the other to fasten the first and second ends of the upper and lower rail segments together when the rail segment are in the second deployed position.

11. The rail unit of claim 10 wherein the means for rotating one of the threaded members with respect to the other comprises an electric motor mounted on the second end of the lower rail segment and connected to the threaded member located at the second end of the lower rail segment and means for actuating said motor when the first end of the upper rail segment approaches the second end of the lower rail segment.

12. The rail unit of claim 1 wherein the first end of each rail segment overlaps the second end of a rail segment directly below when the rail segments are in the second deployed position, and the means for securing the first end of one rail segment to the second end of a rail segment directly below when the rail segments are in the second deployed position comprises an externally threaded member located at the level of and on the building side of the overlapping ends of the upper rail segment and the lower rail segment when they are in the deployed position, the first of the lower rail segment having an oversized bore in alignment with the externally threaded member and the second end of the upper rail segment having a mating internally threaded hole in alignment with the externally threaded member, and means for rotating the externally threaded member to fasten the first and second ends of the upper and lower rail segments together when the rail segments are in the second deployed position.

13. The rail unit of claim 12 wherein the means for rotating one of the threaded members with respect to the other comprises an electric motor supported from the building and connected to the externally threaded member and means for actuating said motor when the first end of the upper rail segment approaches the second end of the lower rail segment.

* * * * *